US008221246B2

(12) United States Patent
Lee et al.

(10) Patent No.: US 8,221,246 B2
(45) Date of Patent: Jul. 17, 2012

(54) ENTERTAINMENT CHAIR

(75) Inventors: Steve Lee, Park Ridge, IL (US); Chris Daisy, Chicago, IL (US)

(73) Assignee: eFurn Holdings, LLC, Elk Grove Village, IL (US)

( * ) Notice: Subject to any disclaimer, the term of this patent is extended or adjusted under 35 U.S.C. 154(b) by 742 days.

(21) Appl. No.: 12/334,251

(22) Filed: Dec. 12, 2008

(65) Prior Publication Data

US 2009/0152910 A1 Jun. 18, 2009

Related U.S. Application Data

(60) Provisional application No. 61/007,680, filed on Dec. 13, 2007.

(51) Int. Cl.
*G06F 19/00* (2011.01)

(52) U.S. Cl. ..... 463/46; 463/47

(58) Field of Classification Search ..... 463/36, 463/40, 46, 47; 297/92, 93, 94, 105, 183.6, 297/183.9, 180.16, 216.11, 195.11, 217.1, 297/217.2, 217.3, 217.4, 217.7
See application file for complete search history.

(56) References Cited

U.S. PATENT DOCUMENTS

| | | | | |
|---|---|---|---|---|
| 6,307 | A * | 4/1849 | Linzie | 297/180.16 |
| 1,767,925 | A | 6/1930 | Hargreaves | |
| 2,434,058 | A * | 1/1948 | Stenzel | 297/260.1 |
| 2,650,644 | A * | 9/1953 | Malco | 297/108 |
| 2,693,846 | A | 11/1954 | Luttio | |
| 3,497,258 | A * | 2/1970 | Hill | 472/135 |
| 3,628,829 | A | 12/1971 | Heilig | |
| 3,635,528 | A * | 1/1972 | Strom | 297/452.41 |
| 3,775,785 | A | 12/1973 | Mittendorf | |
| 3,817,574 | A | 6/1974 | McNab | |
| 3,902,759 | A | 9/1975 | Monteforte et al. | |
| 3,951,453 | A | 4/1976 | Zapf | |
| 4,023,566 | A | 5/1977 | Martinmaas | |
| 4,036,524 | A | 7/1977 | Takamatsu | |
| 4,042,791 | A | 8/1977 | Wiseman | |
| 4,079,992 | A | 3/1978 | Thrift et al. | |
| 4,460,188 | A | 7/1984 | Maloof | |
| 4,518,203 | A | 5/1985 | White | |

(Continued)

FOREIGN PATENT DOCUMENTS

DE 3408248 A1 9/1985

(Continued)

OTHER PUBLICATIONS

Chvatik (Chvatik, Daniel "Review: Intensor" ATPM 5.03 Mar. 1999 available online as of Sep. 22, 1999 at http://atpm.com/5.03/intensor.shtml).*

(Continued)

*Primary Examiner* — N Drew Richards
*Assistant Examiner* — Grant Withers
(74) *Attorney, Agent, or Firm* — Pauley Petersen & Erickson

(57) ABSTRACT

An entertainment chair includes a base, a bottom surface positioned on a lower portion of the base and a seating surface positioned opposite the bottom surface. The entertainment chair further includes a support surface formed or removeably attachable with respect to the bottom surface and permitting 360 degrees of rotation of the base relative to a floor surface. The entertainment chair further includes an internal control for translating movement of a user to an entertainment system and may further include a means for operably connecting the entertainment chair to an entertainment medium for receiving a signal produced by the entertainment medium.

16 Claims, 12 Drawing Sheets

U.S. PATENT DOCUMENTS 4,528,706 A 7/1985 Branker
4,630,817 A * 12/1986 Buckley ..... 463/37
4,635,306 A 1/1987 Willey
4,802,249 A 2/1989 Bills
4,883,317 A 11/1989 Davenport
5,011,221 A * 4/1991 Wise ..... 297/188.06
5,143,055 A 9/1992 Eakin
5,143,419 A * 9/1992 Tepper et al. ..... 297/183.3
D330,639 S 11/1992 Munro et al.
5,286,084 A 2/1994 Bart
5,299,337 A 4/1994 Venza
D356,250 S 3/1995 Chang
5,419,613 A * 5/1995 Wedeking ..... 297/217.1
5,464,381 A 11/1995 Wilson
5,490,711 A * 2/1996 Pollock ..... 297/186
5,522,639 A * 6/1996 Jaime ..... 297/184.13
5,622,404 A 4/1997 Menne
5,624,156 A * 4/1997 Leal et al. ..... 297/217.4
5,678,886 A 10/1997 Infanti
5,727,844 A 3/1998 O'Quinn et al.
5,785,383 A 7/1998 Otero
5,807,177 A * 9/1998 Takemoto et al. ..... 463/47
5,816,650 A 10/1998 Lucas, Jr.
5,857,986 A 1/1999 Moriyasu
5,919,045 A 7/1999 Tagge et al.
5,984,349 A * 11/1999 Van Voorhies ..... 280/735
6,056,079 A * 5/2000 Cech et al. ..... 180/273
6,102,476 A 8/2000 May et al.
6,109,686 A * 8/2000 Fox ..... 297/105
6,120,468 A 9/2000 Tseng
6,155,647 A 12/2000 Albecker, III
6,206,463 B1 3/2001 Whigham
6,270,155 B1 8/2001 Rashid
6,341,817 B1 1/2002 Stern-Gonzalez
6,419,313 B1 7/2002 Newman
6,422,941 B1 7/2002 Thorner et al.
6,422,944 B1 7/2002 Naghi
6,425,862 B1 * 7/2002 Brown ..... 600/300
6,592,375 B2 7/2003 Henry et al.
6,598,935 B2 * 7/2003 Colliar et al. ..... 297/183.9
6,637,823 B1 10/2003 Ursini et al.
6,744,370 B1 6/2004 Sleichter, III et al.
6,811,218 B2 * 11/2004 Deimen et al. ..... 297/284.1
7,044,558 B2 * 5/2006 Chiu ..... 297/452.41
7,219,956 B2 * 5/2007 Zhang ..... 297/195.11
7,378,978 B2 * 5/2008 Cassaday ..... 340/667
D597,347 S * 8/2009 Lee ..... D6/500
7,789,463 B2 * 9/2010 Gang ..... 297/314
2002/0005649 A1 1/2002 Hofmann et al.
2003/0164627 A1 * 9/2003 Sedlack ..... 297/183.1
2004/0180719 A1 * 9/2004 Feldman et al. ..... 463/36
2004/0254020 A1 * 12/2004 Dragusin ..... 463/46
2005/0140197 A1 * 6/2005 Lee ..... 297/378.12
2005/0168021 A1 * 8/2005 Real et al. ..... 297/217.3
2005/0233676 A1 * 10/2005 Bohart ..... 446/313
2005/0233807 A1 * 10/2005 Tai ..... 463/36
2005/0264044 A1 * 12/2005 Lee ..... 297/85
2005/0282631 A1 12/2005 Bonney et al.
2006/0014586 A1 * 1/2006 Gatto et al. ..... 463/46
2006/0181134 A1 * 8/2006 Douglas ..... 297/452.41
2007/0108805 A1 * 5/2007 Manning ..... 297/94
2007/0149291 A1 * 6/2007 Mitchell ..... 463/46
2008/0018145 A1 * 1/2008 Tuckey et al. ..... 297/183.3
2008/0191525 A1 * 8/2008 Jensen et al. ..... 297/217.2
2008/0252110 A1 * 10/2008 Vallentin ..... 297/183.3
2009/0079238 A1 * 3/2009 Plikat et al. ..... 297/217.2
2009/0079239 A1 * 3/2009 Endo et al. ..... 297/217.2
2009/0163283 A1 * 6/2009 Childress ..... 463/47
2009/0212605 A1 * 8/2009 Buckner ..... 297/183.9
2010/0038940 A1 * 2/2010 Hwang et al. ..... 297/217.2
2010/0207434 A1 * 8/2010 Kurrasch et al. ..... 297/217.2
2011/0084525 A1 * 4/2011 Endo et al. ..... 297/217.2
2011/0086747 A1 * 4/2011 Broderick ..... 482/142
2011/0109134 A1 * 5/2011 Filipour et al. ..... 297/217.4

FOREIGN PATENT DOCUMENTS

JP 02169337 A * 6/1990

OTHER PUBLICATIONS

Design News Staff ("Gyroscopic Sensors Aim for New Applications" Design News website Sep. 25, 2006 available: www.designnews.com/document.asp?doc_id=212756).*

* cited by examiner

ENTERTAINMENT CHAIR

CROSS REFERENCE TO RELATED APPLICATION

This application claims the benefit of U.S. Provisional Application No. 61/007,680 filed on 13 Dec. 2007, and which is incorporated by reference herein and is made a part hereof, including but not limited to those portions which specifically appear in this Patent Application.

BACKGROUND OF THE INVENTION

1. Field of the Invention

This invention relates to a furniture piece, specifically a chair, for use with multimedia devices.

2. Description of Related Art

With the increasing popularity of entertainment media such as music players, computer-related video games and other multimedia devices, there is a demand for entertainment chairs which provide stimulation to the occupant of the entertainment chair based upon signals from an entertainment medium.

SUMMARY OF THE INVENTION

According to a preferred embodiment of this invention, an entertainment chair includes a seating surface arranged in a compact structure including a base and an integrated back. The seating surface is positioned on an upper portion of the base, and a bottom surface is positioned on a lower portion of the base.

According to another preferred embodiment of this invention, an entertainment chair includes a base and an arm integrated with the base. The entertainment chair may further include a handle mounted with respect to a free end of the arm, opposite the base. The base preferably includes an upper portion and an opposing lower portion. The base preferably further includes three open sides. The arm is preferably a cantilevered arm integrated with the base and extending from the base at an angle of between about 10 degrees and about 90 degrees relative to a floor surface.

The entertainment chair of this invention may further include an integrated video game control system, such as one or more gyroscopic devices, that may permit one or more users to move the entertainment chair to responsively manipulate a video game character, vehicle and/or activity. The entertainment chair may include speakers, a vibrator, or both, attached on or within the entertainment chair and capable of providing auditory and/or tactile sensation to a user of the entertainment chair. The vibrator and speakers are operably connectable to an entertainment medium so as to be responsive to a signal produced from the entertainment medium.

Other advantages of this invention will be apparent to those skilled in the art, in view of the following detailed description taken in conjunction with the appended claims and drawings.

BRIEF DESCRIPTION OF THE DRAWINGS

The drawings show an entertainment chair, according to preferred embodiments of this invention.

Figure 1:
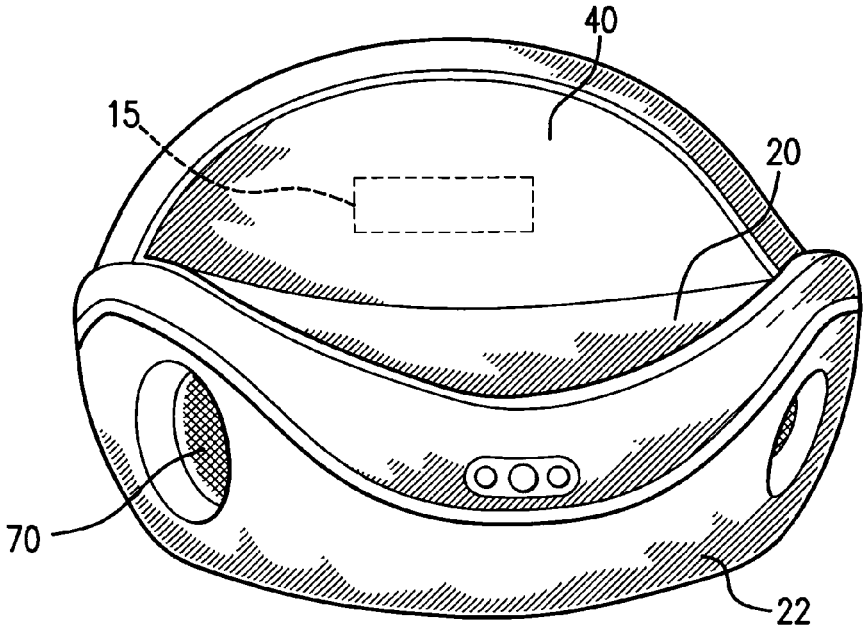
FIG. 1 is a front left perspective view of a chair according to one preferred embodiment of this invention.

It should be understood that the drawings are of preferred embodiments, and that there may be other embodiments of this invention. Therefore, it should be understood that the drawings are not intended to limit the scope of this invention, but that the scope of this invention be defined by the claims that follow the description of preferred embodiments.

DESCRIPTION OF PREFERRED EMBODIMENTS

FIGS. 1-23 show entertainment chairs according to various preferred embodiments of this invention. Each of the figures shows an entertainment chair of this invention having one or more features enabling use in connection with one or more multimedia devices.

The terms "furniture piece," "chair" and "entertainment chair" will be used interchangeably throughout this description of preferred embodiments.

In some embodiments, such as shown in FIGS. 1-16, the furniture piece 10 desirably comprises base 30 and backrest 40 integrated with base 30. Entertainment chair 10 may form any other suitable furniture piece including, but not limited to, an ottoman, a couch or a sofa. Base 30 includes bottom surface 22 positioned on a lower portion of base 30, and seating surface 20, positioned opposite bottom surface 22. Additional embodiments, such as shown in FIGS. 17-20, may additionally include a means for rolling, such as tripod 120 and wheels 110. According to a preferred embodiment of this invention shown in FIGS. 1-8 and 12-16, base 30 comprises a convex support surface 35 so as to create a dynamic seating position whereby user movements and inputs to entertainment chair 10 result in a corresponding movement of the entirety of entertainment chair 10. According to another preferred embodiment of the invention shown in FIGS. 9-11, base 30 comprises a flat support surface 37. An adapter (not shown) may be utilized to adapt base 30 from convex support surface 35 to flat support surface 37 and vice versa. Support surface 35 may include and/or be covered by a slip proof material to prevent chair 10 from sliding on a floor surface when in use. For example, in one embodiment of this invention, support surface 35 may be covered by a rubber-like material. Support surface 35 may be integrated with bottom surface 22. Alternatively, support surface 35 may be a separate element, removeably attachable to chair 10, such as by screws or other method known to those skilled in the art.

Further, furniture piece 10 may have at least one tactile transducer, such as a mechanical vibrator (not shown), one or more auditory transducers, or both, desirably contained within furniture piece 10 so as to be protected during shipping and further provide a streamlined profile for furniture piece 10. The auditory transducers, such as speakers 70, are desirably protected but opened to the ambient environment for a clear reproduction of sound, such as by having a perforated grill, screen or cover 75. Means for powering the vibrator and/or speakers 70 may be provided as indicated by an electric cord 90 leading to an amplifier, a transformer, a rectifier, or the like (not shown) as will be understood in the art.

Base 30 and/or back 40 of entertainment chair may contain at least a portion of one or more speakers 70 that are preferably integrated with respect to the base 30 to allow for easy shipping and/or storage of entertainment chair 10. As seen in FIGS. 1-20, entertainment chair 10 may have one or more speakers 70 attached on or within base 30. In one embodiment, speaker 70 may desirably be placed within back 40 and/or any other suitable place on entertainment chair 10.

An input/output and/or control panel 60 may provide means for operably connecting furniture piece 10 to an entertainment medium (not shown) so as to receive a signal produced from the entertainment medium. The input/output (I/O) and control panel 60 may also provide a headphone jack, on/off switch, volume and/or vibration controls such as potentiometers or the like, and such as described in more detail below.

In some embodiments, entertainment chair 10 may further include one or more integrated gaming controls 15 including gyroscopic controls and/or similar inertia and/or movement based control systems. Such integrated gaming controls 15 may be configured to enable user movement on entertainment chair 10 to create a corresponding movement in a video game or similar video entertainment system.

According to one preferred embodiment of this invention shown in FIGS. 1-8 and 12-16, and as briefly described above, base 30 may comprise a convex support surface 35 so as to create a dynamic seating position whereby user movements and inputs to entertainment chair 10 result in a corresponding movement of the entirety of entertainment chair 10. In addition, control panel 60 may include one or more connections to a video and/or audio entertainment system. For instance, entertainment chair 10 may contain one or more gyroscopic gaming controls whereby a movement of entertainment chair 10 results in a corresponding movement in a video game. Alternatively, or additionally, an audio device may be connected with respect to entertainment chair 10 and a user may respond to audible instructions emitted from the audio device, either as a gaming system or a means for working out, or both. Specifically, an audio device may instruct a user to lean to the left, lean to the right, lean forward or backward, in any combination or succession.

According to one preferred embodiment of entertainment chair 10, a video game system may include a video game with a user controlled virtual character or virtual vehicle that is responsive to the movements of the user on entertainment chair 10. Convex support surface 35 preferably facilitates movement of the user and a resulting movement of entertainment chair 10 whereby internal gaming controls 15 then provide electronic instructions or signals to the video game system. Likewise, entertainment chair 10 shown in FIGS. 17-20, that includes wheels 110, may include a similarly responsive user movement input to correspondingly control a virtual activity. Internal gaming controls 15 are preferably responsive to any number of user stimuli, such as, for example, basic three-axis movement or motion. For instance, a user leans left to control leftward movement, a user leans right to create rightward movement, a user leans backward to result in upward movement and a user leans forward to result in downward movement. Likewise, rotational movement and/or any other similar stimuli may prompt appropriate signals from entertainment chair 10 to a video game or video entertainment system.

Figure 2:
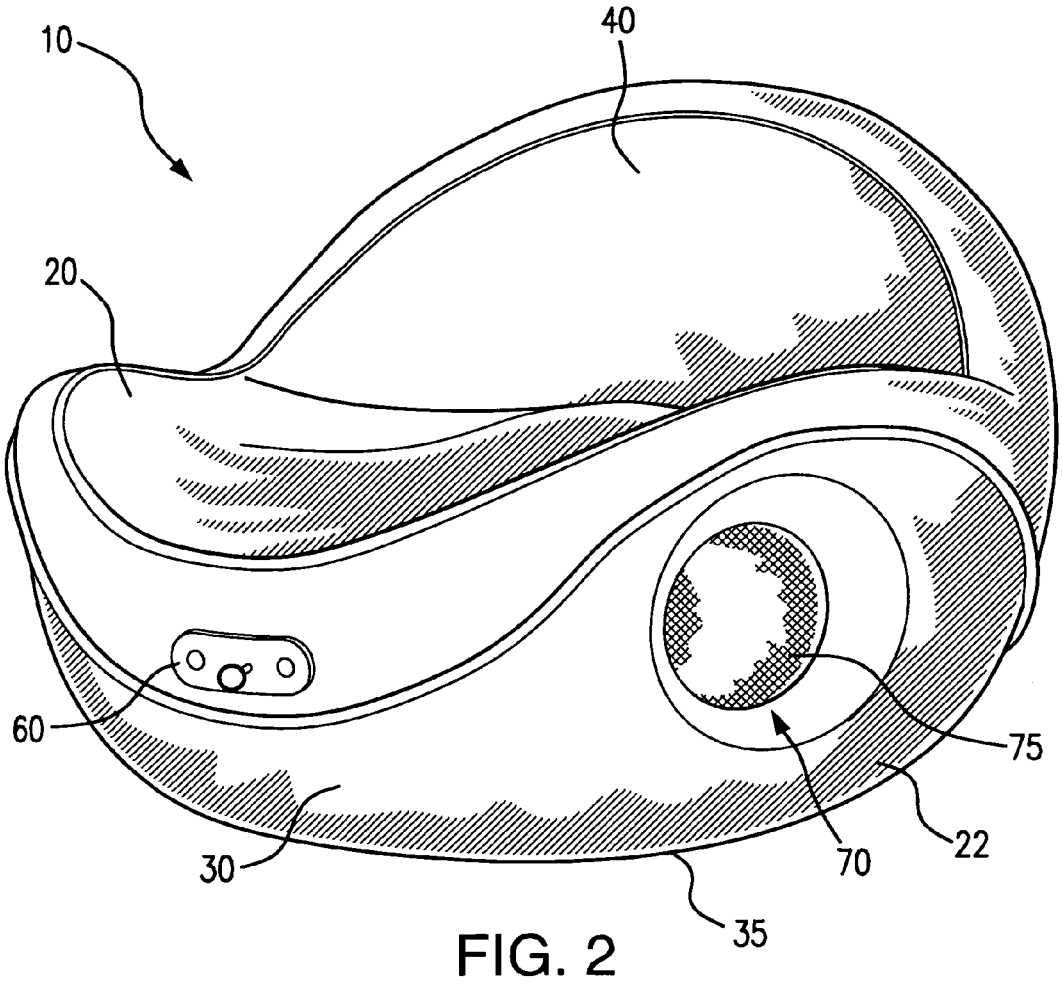
FIG. 2 is a front right perspective view of the chair shown in FIG. 1.
Figure 3:
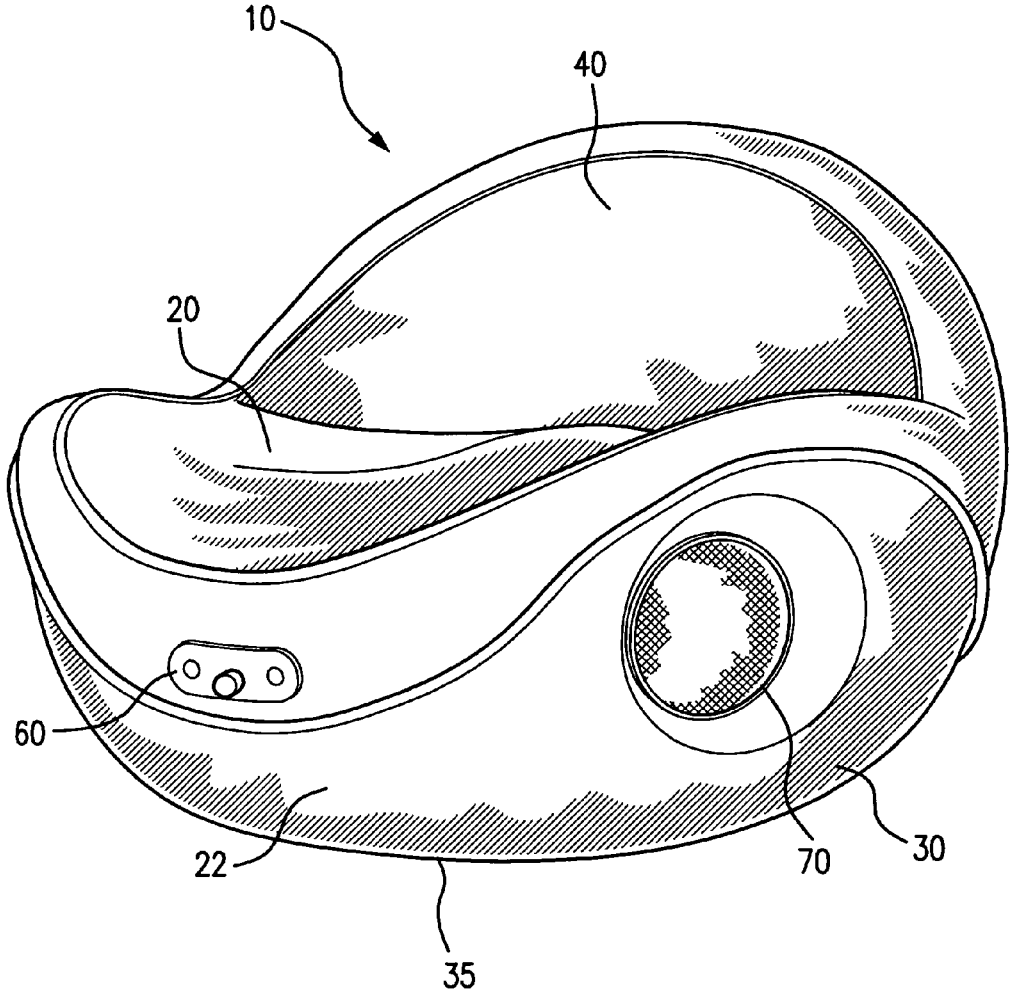
FIG. 3 is a front perspective view of a chair, according to one embodiment of this invention.
Figure 4:
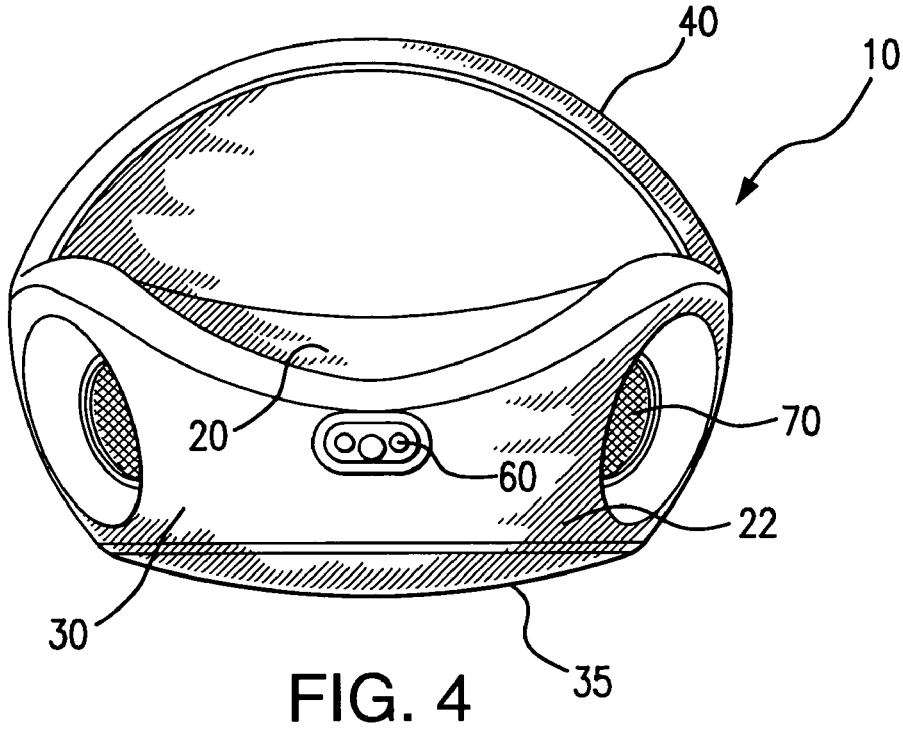
FIG. 4 is a front view of a chair, according to one preferred embodiment of this invention.
Figure 5:
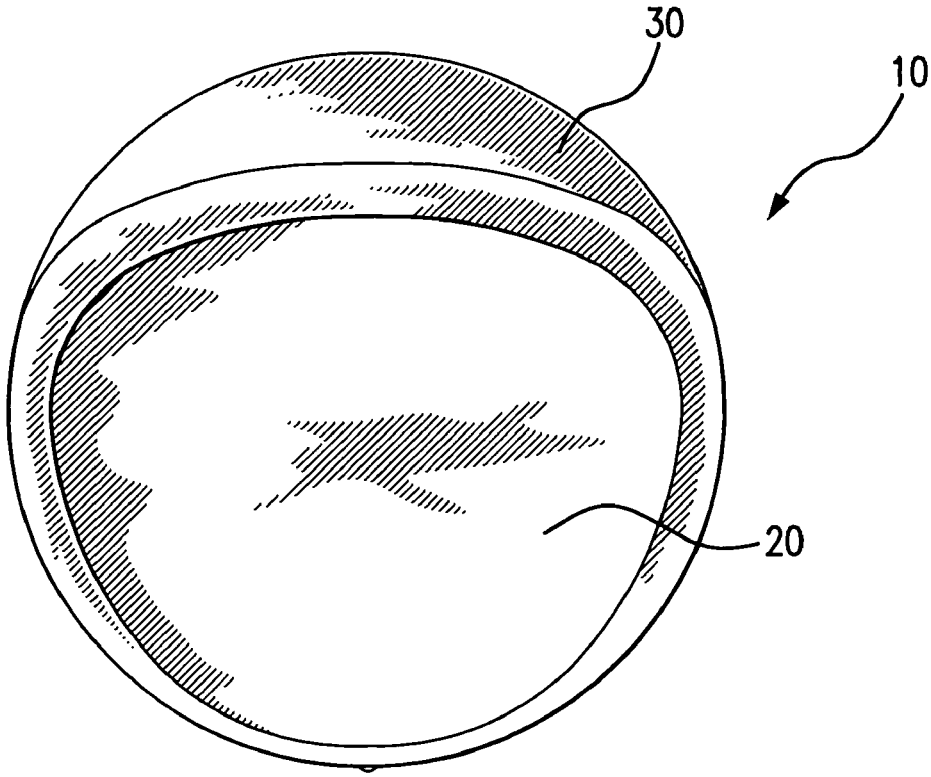
FIG. 5 is a top view of the chair, as shown in FIG. 4.
Figure 6:
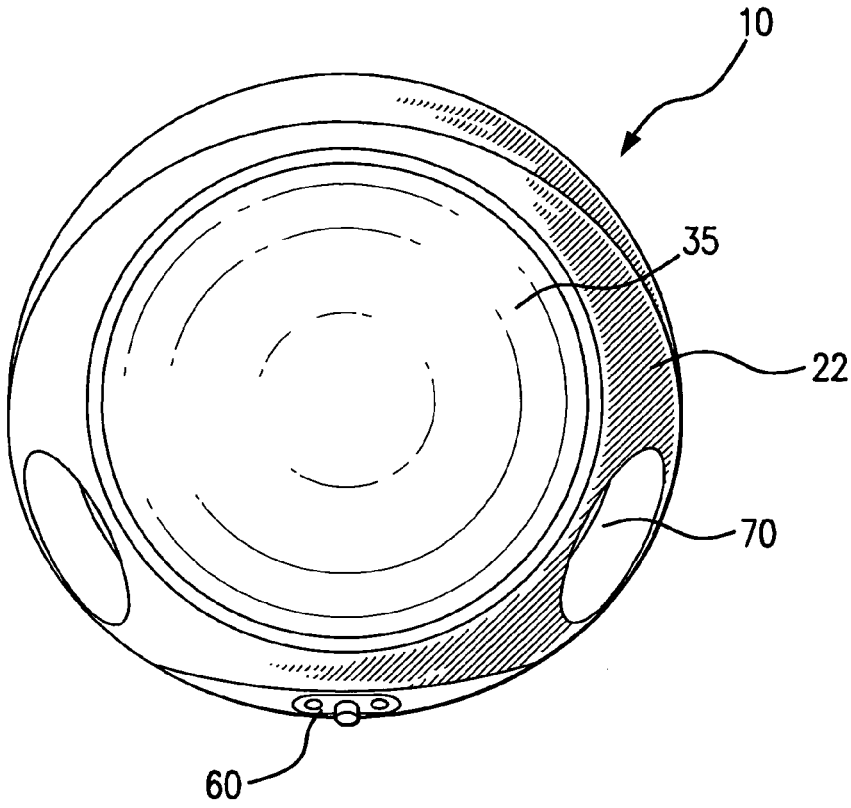
FIG. 6 is a bottom view of the chair, as shown in FIG. 4.
Figure 7:
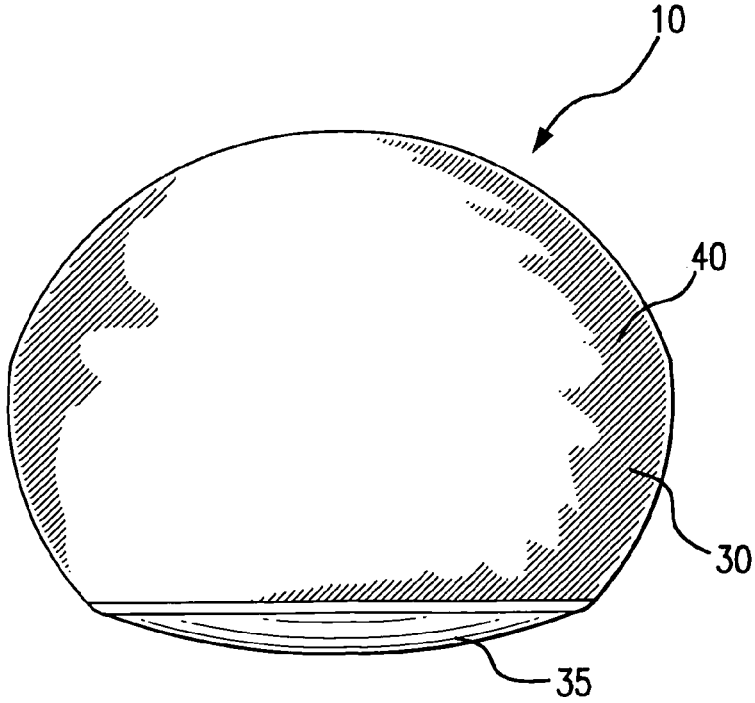
FIG. 7 is a back view of the chair, as shown in FIG. 4.
Figure 8:
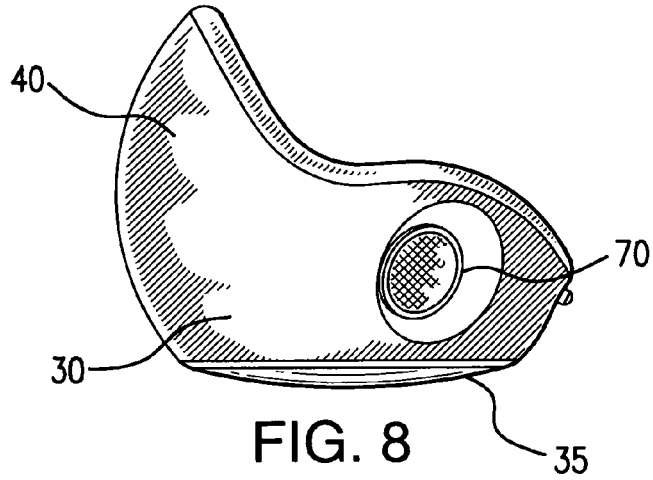
FIG. 8 is a side view of the chair, as shown in FIG. 4, wherein the opposite side view is a mirror image thereof.
Figure 9:
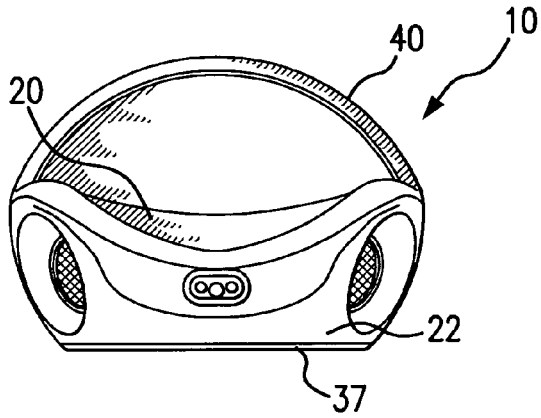
FIG. 9 is a front view of a chair, according to one preferred embodiment of this invention.
Figure 10:
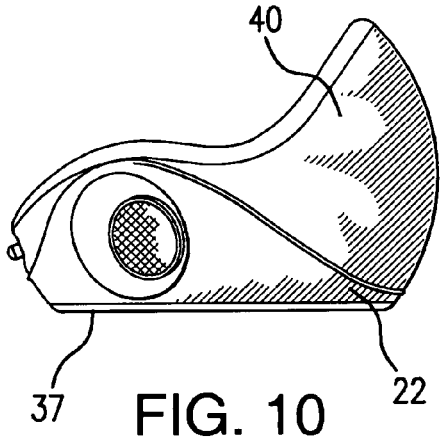
FIG. 10 is a side view of the chair, as shown in FIG. 9.
Figure 11:
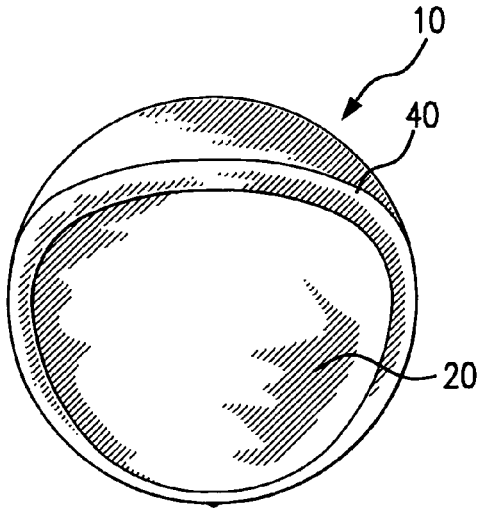
FIG. 11 is a side view of the chair, as shown in FIG. 9.
Figure 12:
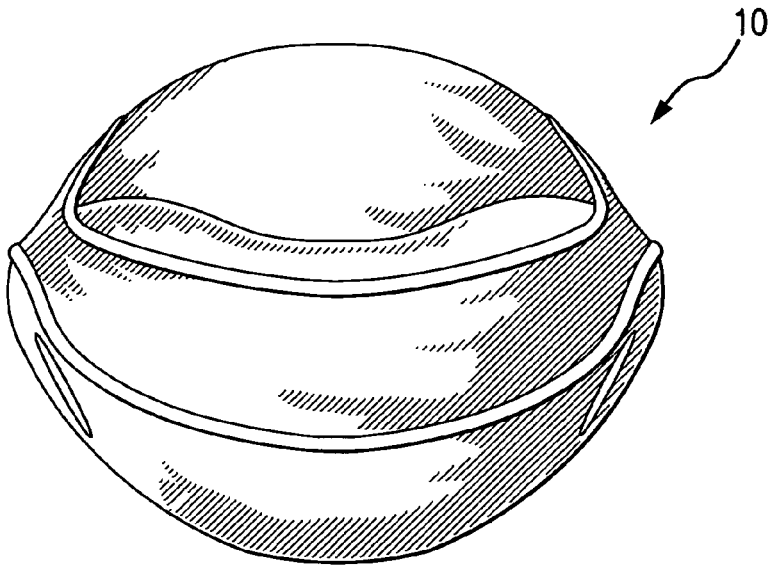
FIG. 12 is a front view of a chair, according to one preferred embodiment of this invention.
Figure 13:
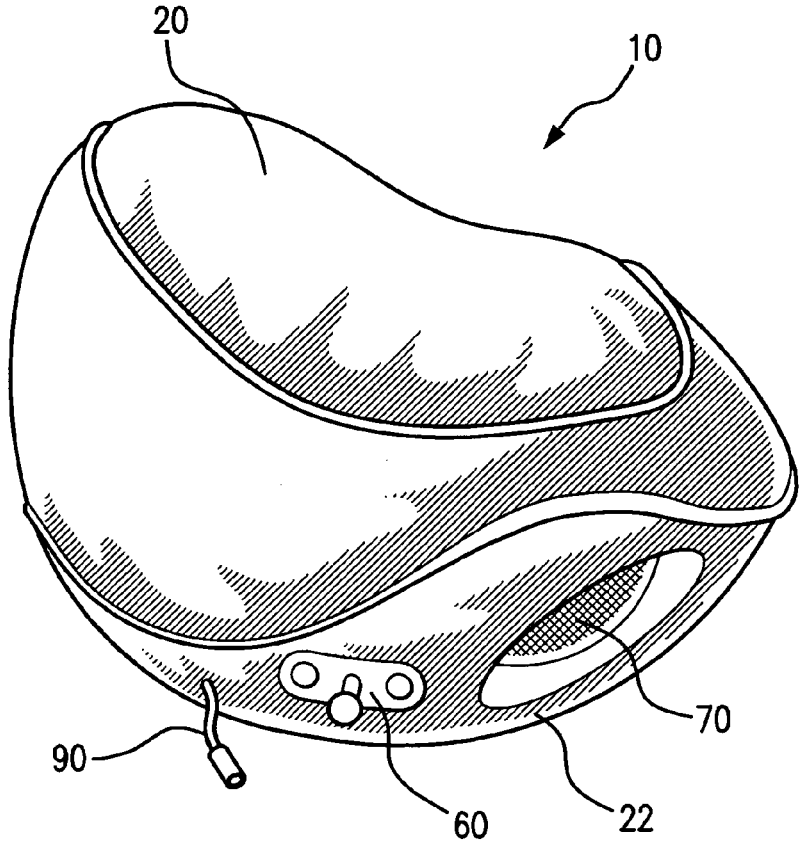
FIG. 13 is a side view of the chair, as shown in FIG. 12.
Figure 14:
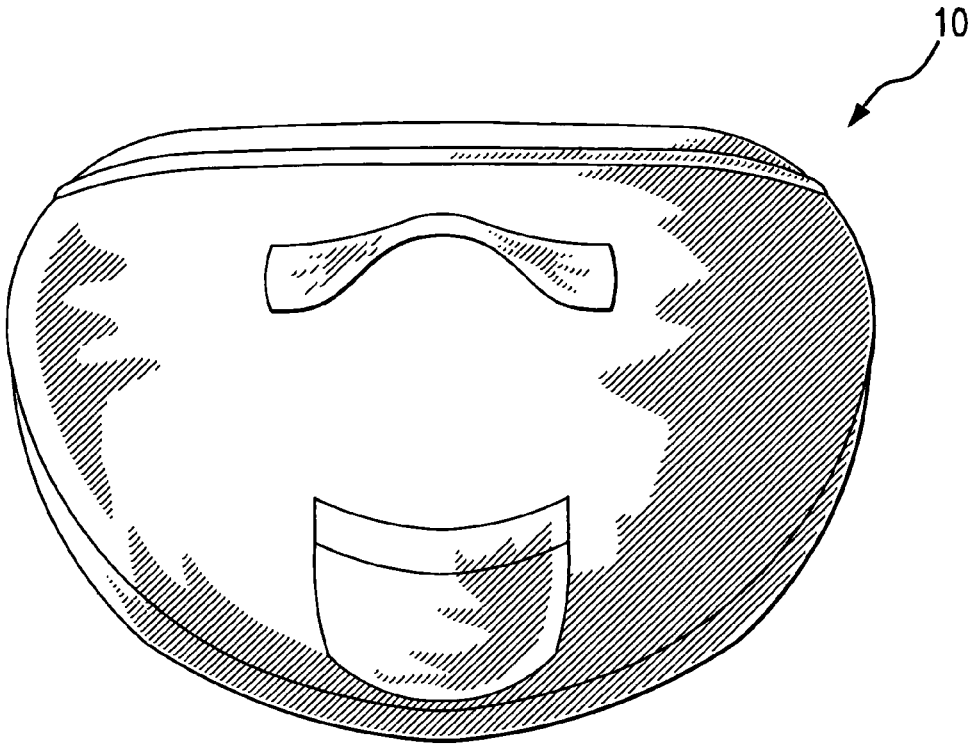
FIG. 14 is a back view of the chair, as shown in FIG. 12.
Figure 15:
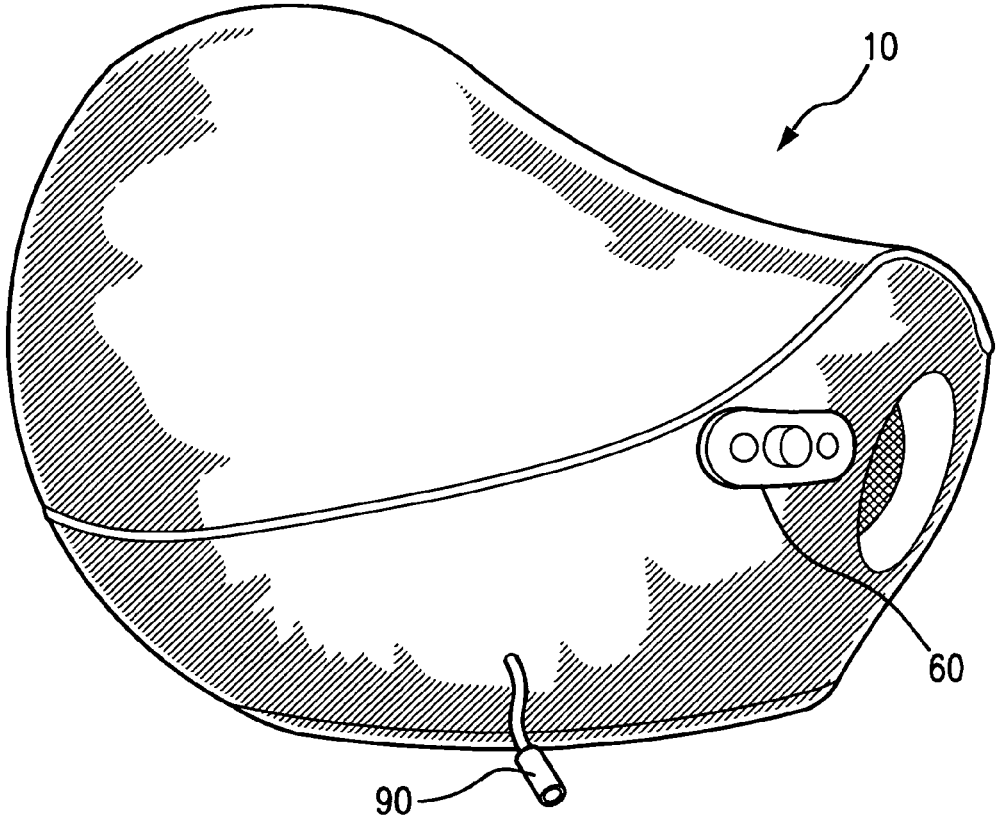
FIG. 15 is a side perspective view of the chair, as shown in FIG. 12.
Figure 16:
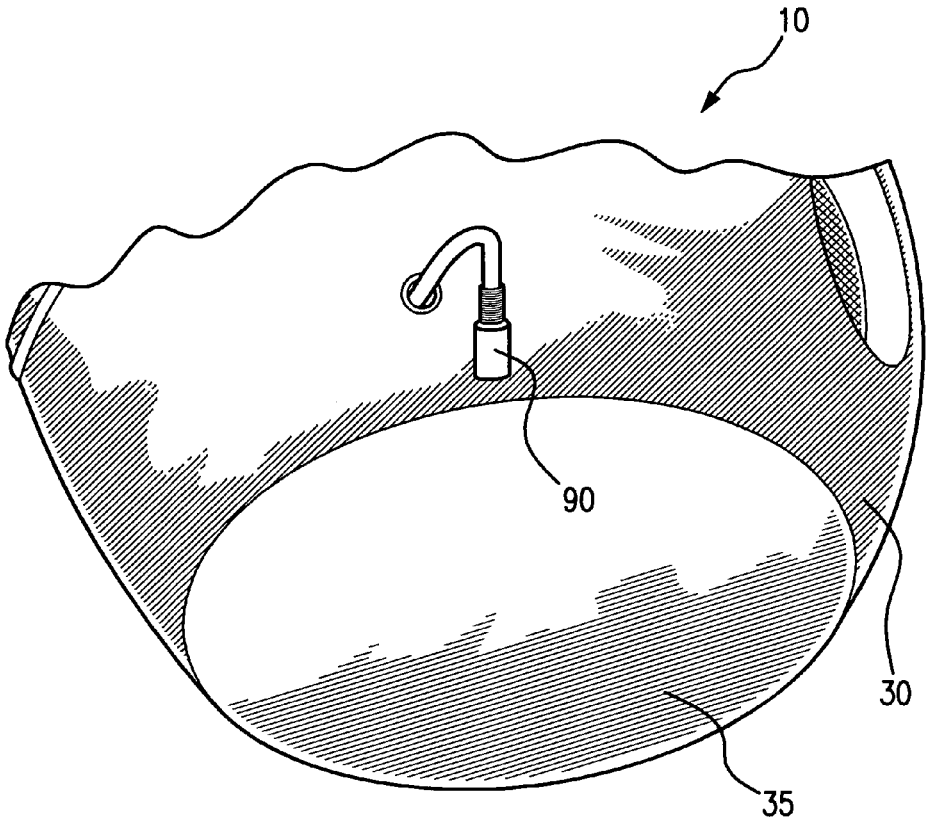
FIG. 16 is a bottom perspective view of the chair, as shown in FIG. 12.
Figure 17:
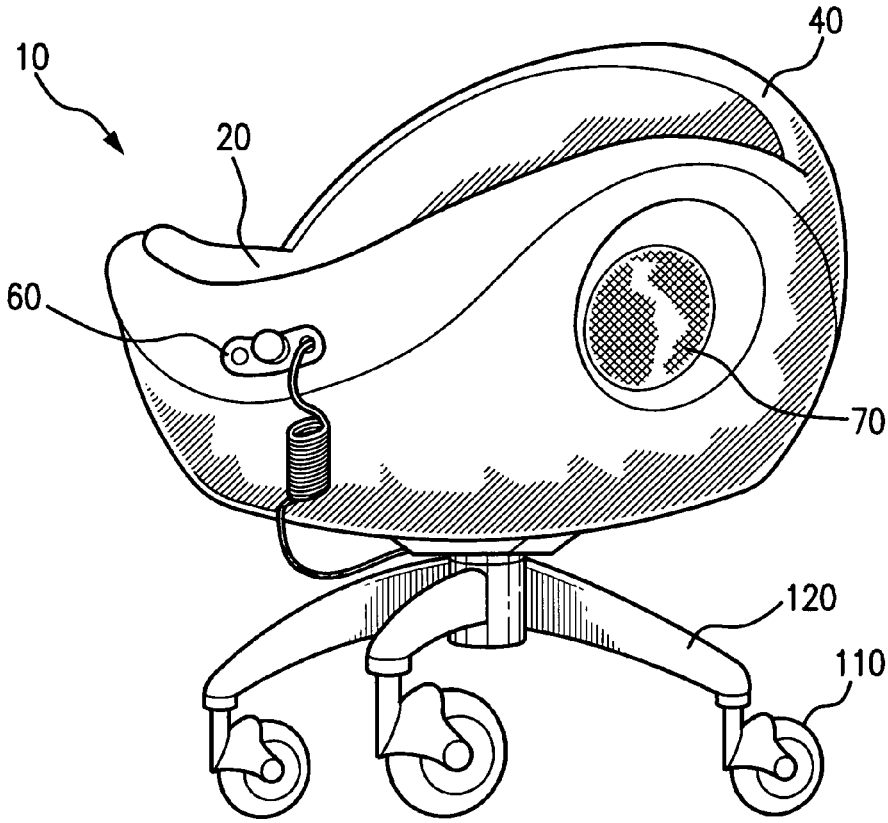
FIG. 17 is a corner perspective view of a chair, according to an alternate preferred embodiment of this invention.
Figure 18:
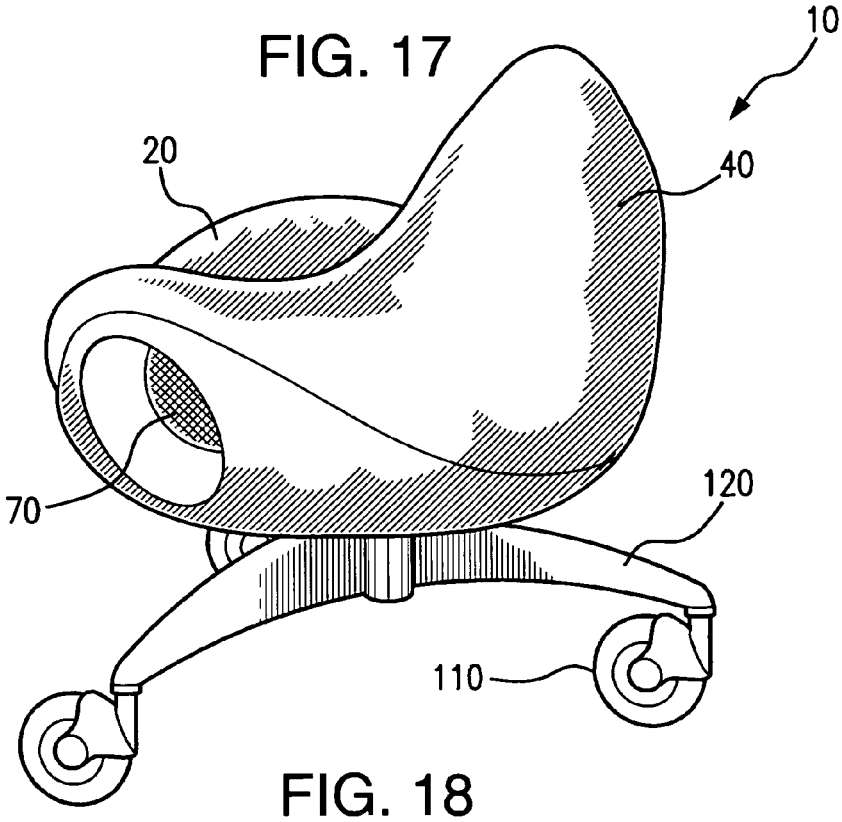
FIG. 18 is a side perspective view of the chair, as shown in FIG. 17.
Figure 19:
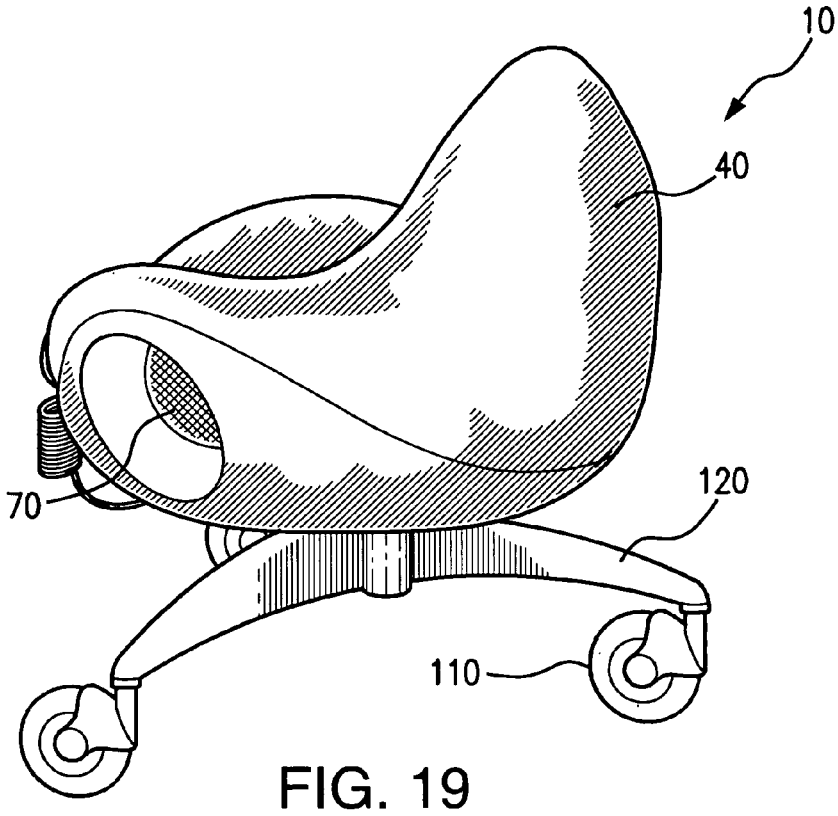
FIG. 19 is a rear corner perspective view of the chair, as shown in FIG. 17.
Figure 20:
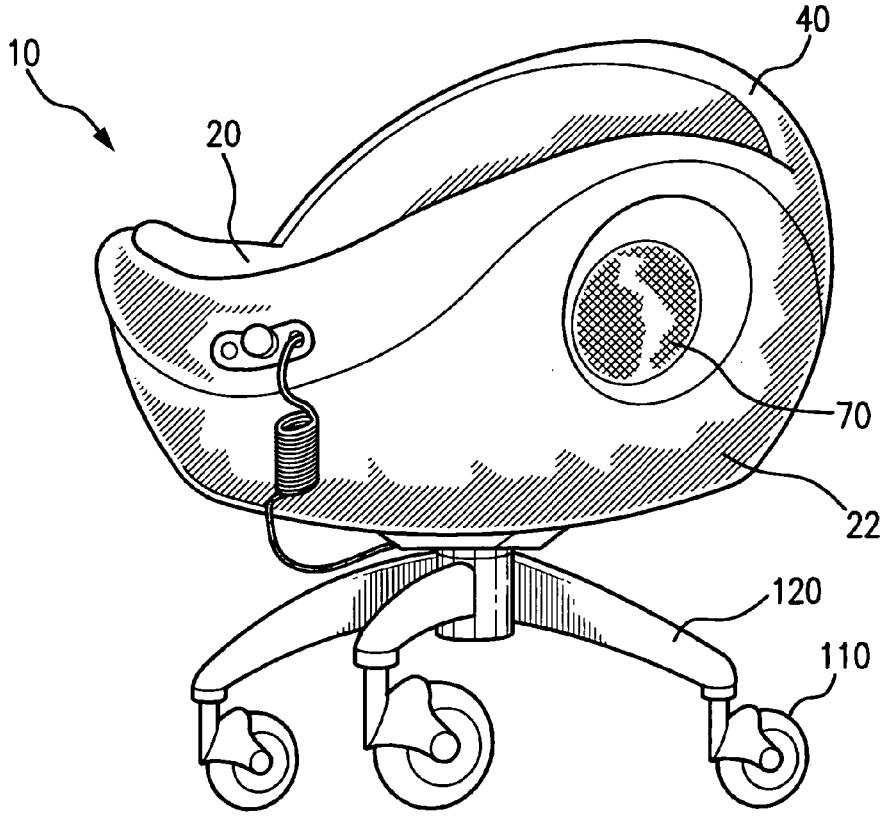
FIG. 20 is a side perspective view of the chair, as shown in FIG. 17.

FIGS. 1 and 2 demonstrate one preferred embodiment of control panel 60. Control panel 60 may include one or more separate adjustment devices for vibration, for tone such as bass/treble, and/or for volume. A knob, toggle, button or similar adjustment device may be used to adjust the desired parameter or parameters. In addition, control panel 60 may include a power switch, one or more headphone jacks and/or one or more input jacks. Control panel 60 may further include one or more "audio out" jacks for connecting one or more entertainment chairs 10 and/or other audio/vibration devices in series.

According to a preferred embodiment of this invention, one or more vibrators and/or speakers 70 are separately connected to the respective adjustment device and thereby separately and independently controllable. As such, speaker 70 may be positioned with respect to seating surface 20 and a vibrator may be positioned with respect to base 30. A control, such as, for example, control panel 60, for controlling a volume output of speaker 70 and a vibration output of the vibrator is connected with respect to speaker 70 and the vibrator so that a volume output is independent of a vibration output. According to a preferred embodiment of this invention, the vibrator and/or speaker 70 are operably connectable to an entertainment medium so as to be responsive to a signal produced from the entertainment medium.

As described, the control, such as control panel 60, includes a volume control for controlling the volume output of the speaker; a bass/treble control for controlling the frequency and/or tonal output of the speaker; and/or a vibration control for controlling the vibration output of the vibrator. According to a preferred embodiment of this invention, the vibration control produces a vibration output from the vibrator independent of the volume output of speaker 70. Likewise, according to a preferred embodiment of this invention, the volume control produces a volume output from speaker 70 independent of the vibration output of the vibrator. As such, depending upon the desired application, a user can adjust volume control down or off and vibration control to a desired level resulting in vibration output from entertainment chair 10 but no volume output. Conversely, the user can adjust vibration control down or off and volume control to a desired level and avoid any vibration output. As a result of the described embodiment of entertainment chair 10 having both a vibrator and speaker 70, the resulting entertainment chair 10 does not necessarily rely on speaker 70, such as a transducer or low frequency bass output, for vibration. This may have applicability if the user does not want vibrations during a period of music listening or if the user does not want appreciable speaker volume during video game play involving tactile response features.

Alternatively, vibration is derived entirely from speaker output, such as a transducer or low frequency bass output, for vibration. In such an embodiment, a volume control may be the sole means of adjusting both a volume output and a vibration output.

As a result of the described configuration, entertainment chair 10 may include one or more vibrators and one or more speakers 70 that have dependent or independent control and output. The resulting entertainment chair 10 is thereby entirely flexible to user selected volume, vibration and/or tone.

According to one embodiment of entertainment chair 10, not shown in the figures, a compartment may be formed by or within base 30. In one preferred embodiment of this invention, furniture piece 10 further comprises seating surface 20 covering at least a portion of the compartment. A vibrator and/or game controls may be mounted to the surface of seating surface 20, facing the compartment. The compartment may further contain a speaker which might be a speaker of the subwoofer-type whose sonic vibrations are enhanced by the cavity of the compartment. Suitable electrical connections (not shown) between the electrical and electronic components may be easily routed through the compartment. The compartment may further provide storage for entertainment media, headphones, or the like (not shown).

An exemplary embodiment of a vibrator for use in the present invention may comprise at least an electric motor with a motor shaft. The motor shaft may be coupled to an eccentric weight. A housing desirably contains the motor, the motor shaft, and the eccentric weight. As described, the eccentric weight is mounted to a separate shaft which is coupled to the motor shaft by a mechanical coupling at a first end of the separate shaft. A second end of the separate shaft is coupled to the housing. A connector plate is affixed to, or integral with, the housing for mounting the vibrator, preferably in a direct coupling to the entertainment chair. An amplifier may be connected to the motor for control of vibration level. For example, as a sound volume of the entertainment media increases, the power to the motor may correspondingly increase, thereby increasing the rotational speed or torque of the motor and the turning of the eccentric weight, thereby increasing the vibration. Amplifier settings may be controlled through the I/O and/or control panel.

Figure 21:
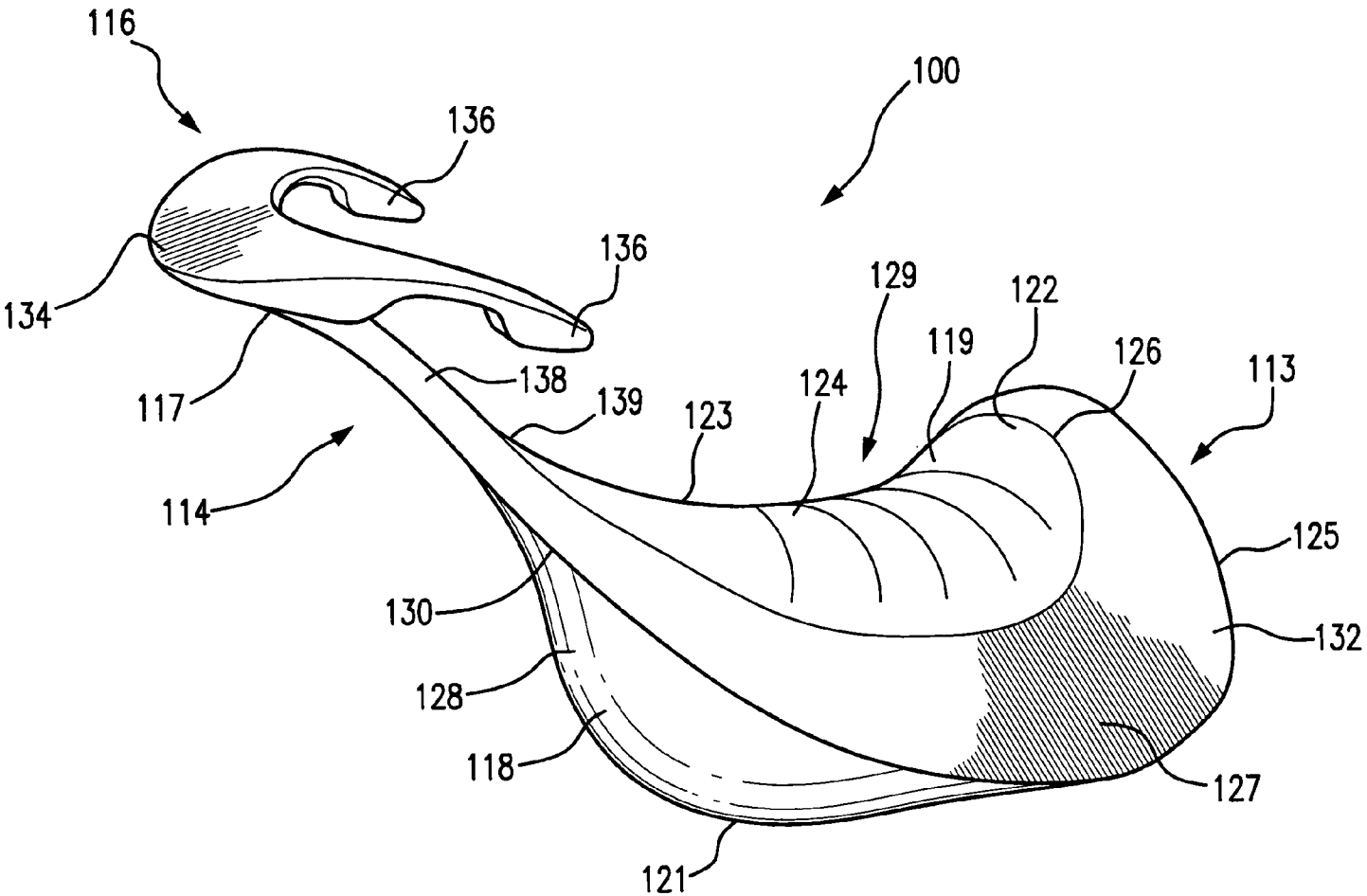
FIG. 21 is a left side perspective view of a chair according to one embodiment of this invention.
Figure 22:
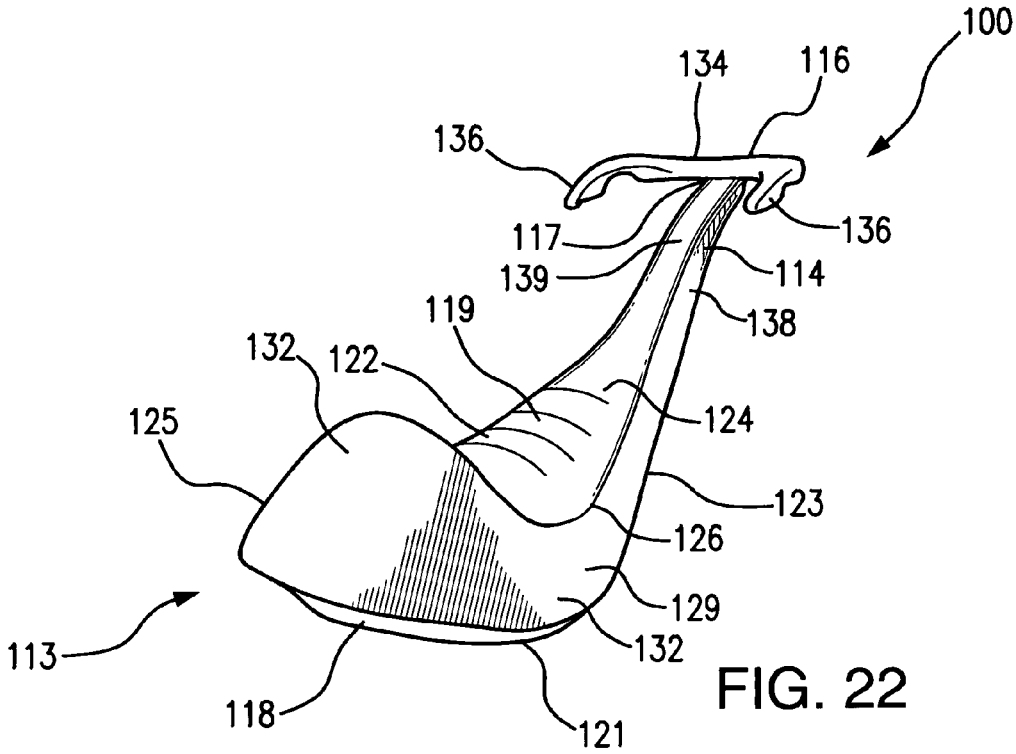
FIG. 22 is a front right perspective view of the chair shown in FIG. 21.
Figure 23:
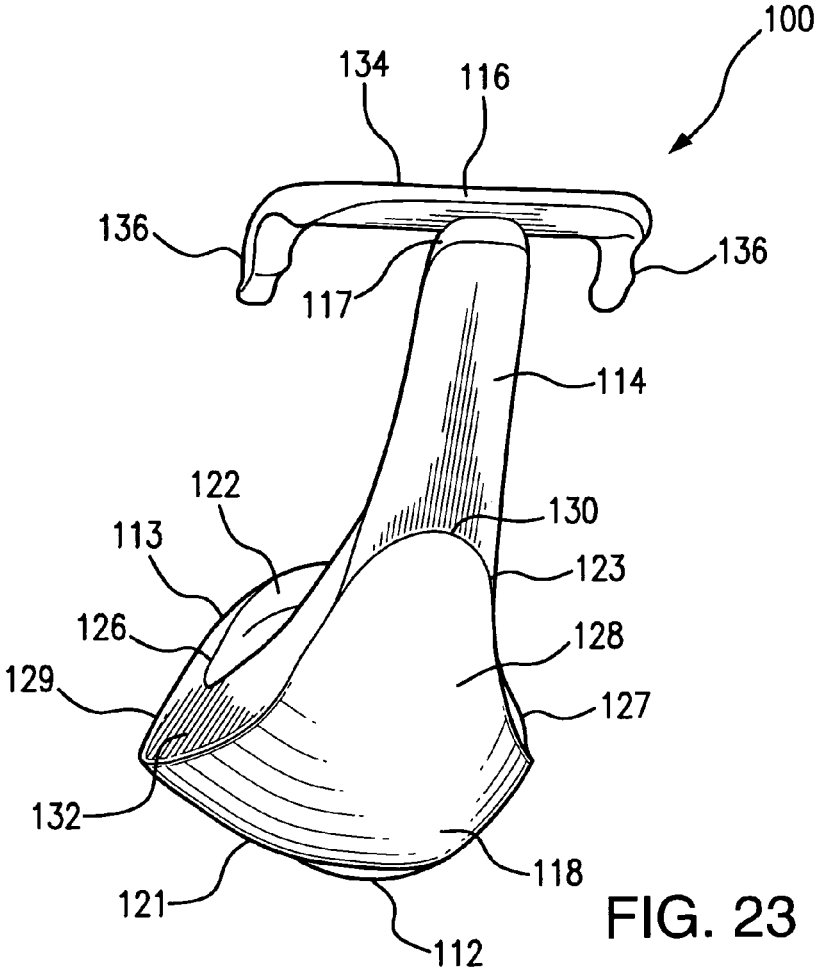
FIG. 23 is a back perspective view of the chair shown in FIG. 21.

FIGS. 21-23 show entertainment chair 100 according to another preferred embodiment of this invention.

With reference to FIGS. 21-23, entertainment chair 100 preferably includes base 113 and arm 114 integrated with base 113. Arm 114 is preferably a cantilevered arm integrated with first end 123 of base 113. Arm 114 includes free end 117, opposite base 113, as shown in FIG. 21. Entertainment chair 100 preferably further includes handle 116 integrated or mounted with respect to free end 117. Entertainment chair 100 may also include an internal control for translating movement of one or more users of entertainment chair 100 to an entertainment system, such as, for example, a video game. Entertainment chair 100 is preferably positionable on a floor surface (not shown), such as, for example, a floor or any other suitable surface able to accommodate and support the entertainment chair of this invention.

Base 113 is preferably a structure including upper portion 119, opposing lower portion 121, and four sides. Three of the four sides of base 113, namely, first side 127, opposing second side 129 as well as second end 125, form the three open sides of base 113. The fourth side of base 113, namely, first end 123, positioned opposite second end 125, extends out and away from base 113, to form cantilever arm 114, which projects from base 113 at an angle relative to the floor surface. Arm 114 desirably extends from and is integrated with first end 123.

With reference to FIGS. 21-23, entertainment chair 100 preferably includes seating surface 122 positioned on upper portion 119. Entertainment chair 100 further includes bottom surface 118 positioned on lower portion 121, opposite seating surface 122.

In one embodiment of this invention, seating surface 122 may define first shape 124 having and defined by first periphery 126. In one embodiment of this invention, as shown in FIG. 21, seating surface 122 has a first curvature from first end 123 to second end 125, and a second curvature from first side 127 to second side 129. In the embodiment of entertainment chair 100 shown in FIG. 21, the first curvature of seating surface 122 is a concave curvature, oriented from first end 123 to second end 125, and the second curvature is a convex curvature oriented from first side 127 to second side 129. Seating surface 122 may have other suitable or desirable shapes and/or curvatures. The shape and/or curvature of seating surface 122 may correspond and/or be conformable to the contours of one or more users. Seating surface 122 preferably accommodates at least one user and may accommodate two or more users. In one embodiment of this invention, seating surface 122 accommodates two users.

Seating surface 122 may be made of and/or covered with fabric, upholstery and/or other suitable material.

With reference to FIGS. 21-23, base 113 preferably includes bottom surface 118 positioned on lower portion 121 of base 113, opposite seating surface 122. Bottom surface 118 may define second shape 128 having and defined by second periphery 130. In one embodiment of this invention, as shown in FIGS. 21-23, bottom surface 118 has a generally convex curvature.

Bottom surface 118 may further include support surface 112 permitting 360 degrees of rotation of base 113 relative to a floor surface, which supports entertainment chair 100 during use. In one embodiment of this invention, support surface 112 is integrated with bottom surface 118. In another embodiment of this invention, support surface 112 is a separate element attached, connected and/or removably positioned relative to bottom surface 118.

In one embodiment of this invention, as shown in FIG. 21, entertainment chair 100 further includes side surface 132 connected along at least a portion of first periphery 126 of seating surface 122 and along at least a portion of second periphery 130 of bottom surface 118. As shown in FIG. 21, side surface 132 may extend between seating surface 122 and bottom surface 118 along first side 127, second end 125, and second side 129 of base 113. Alternatively, seating surface 122 can directly contact bottom surface 118 along at least a portion of its periphery, with or without forming a visible seam therebetween. As shown in FIGS. 21 and 23, side surface 132 may be positioned at an angle relative to seating surface 122 and/or relative to the floor surface. The angle is preferably, but not necessarily, other than a 90 degrees angle and preferably comfortably accommodates the legs of a user.

As shown in FIGS. 21-23, entertainment chair 100 preferably further includes arm 114 integrated with base 113. Arm 114 preferably extends from base 113 at an angle of between about 10 degrees and about 90 degrees relative to the floor surface. In one embodiment of this invention, arm 114 extends from base 113 at an angle of between about 30 degrees and about 80 degrees relative to the floor surface.

More preferably, arm 114 extends from base 113 at an angle of between about 40 degrees and about 70 degrees relative to the floor surface. Most preferably, arm 114 extends from base 113 at an angle of between about 50 degrees and about 60 degrees relative to the floor surface.

Arm 114 has free end 117, opposite base 113. In one embodiment of this invention, shown in FIGS. 21-23, side surface 132 of base 113 preferably extends and continues onto and forms side surface 138 of arm 114. Similarly, seating surface 122 may continue onto and form upper surface 139 of arm 114.

Entertainment chair 100 preferably also includes handle 116 mounted with respect to free end 117 of arm 114. According to one embodiment of this invention, handle 116 includes handle bar 134 extending between and connecting a pair of hand grips 136. One hand grip 136 is preferably positioned on either side of handle bar 134. Hand grips 136 may include ergonomic curvatures or features allowing for a better fit with user's hands. Handle bar 134 is preferably, but not necessarily, integrated with hand grips 136. Handle 116 may be made of plastic, metal and/or any other suitable material known to those skilled in the art. In one embodiment of this invention, shown in FIG. 21, arm 114 has curvature towards or around free end 117 thereof. Handle bar 134 may be connected or mounted to arm 114, or, alternatively, may be integrated with arm 114.

Arm 114, handle 116, handle bar 134 and/or hand grips 136 may be moveable relative to chair 100, and the movements of arm 114, handle 116, handle bar 134 and/or hand grips 136 may translate into various video game actions. For example, arm 114, handle 116, handle bar 134 and/or hand grips 136 may be moved up and/or down, to either side and/or rotated. Each movement may translate into a different action in a video game.

Chair 100 of this invention may further include a video game controller (not shown), such as, for example a Wii® controller. The video game controller may be inserted into a receiver or a pocket (not shown) on handle bar 134 to enable movement. Chair 100 may include a plurality of video game controllers directly or indirectly inserted into or attachable to different parts of chair 100, such as, for example, handle bar 134, arm 114 and/or base 113. In a particular embodiment of chair 100, one video game controller may be inserted into a pocket on handle bar 134 and another video game controller may be inserted into a pocket on second end 125 of chair 100.

Entertainment chair 100 of this invention preferably further includes one or more integrated internal controls for translating movement of a user to an entertainment system. In some embodiments, the internal control includes one or more gyroscopic controls and/or similar inertia and/or movement based control systems. Such integrated internal gaming controls may be configured to enable user movement on entertainment chair 100 to create a corresponding movement in a video game or similar video entertainment system.

According to certain preferred embodiments of this invention shown in FIGS. 1-23, base 113 comprises support surface 112, having a convex curvature so as to create a dynamic seating position whereby user movements of and inputs to the entertainment chair result in a corresponding movement of the entirety of the entertainment chair.

In some embodiments, the entertainment chair of this invention may include one or more connections to a video and/or audio entertainment system. For instance, the entertainment chair may contain one or more gyroscopic gaming controls whereby a movement of the entertainment chair results in a corresponding movement in a video game. Additionally or alternatively, an audio device may be connected with respect to the entertainment chair and a user may respond to audible instructions emitted from the audio device, either as a gaming system or a means for working out, or both. Specifically, an audio device may instruct a user to lean to the left, lean to the right, lean forward or backward, in any combination or succession.

According to one preferred embodiment of entertainment chair 100 of this invention, a video game system may include a video game with a user controlled virtual character or virtual vehicle, for example a car, a motorcycle, a boat, a motorboat, a personal water craft, an airplane, a snowmobile, etc., that is responsive to the movements of the user on entertainment chair 100. Convex support surface 112 preferably facilitates movement of the user and a resulting movement of entertainment chair 100 whereby internal gaming controls then provide electronic instructions or signals to the video game system.

Additional embodiments of entertainment chair 100 (not shown), may additionally include a means for rolling, such as a tripod and wheels. Entertainment chair 100 that includes wheels may include a responsive user movement input to correspondingly control a virtual activity as described above. Internal gaming controls are preferably responsive to any number of user stimuli, such as, for example, basic three-axis movement or motion. For instance, a user leans left to control leftward movement, a user leans right to create rightward movement, a user leans backward to result in upward movement and a user leans forward to result in downward movement. Likewise, rotational movement or any other similar stimuli may prompt appropriate signals from entertainment chair 100 to a video game or video entertainment system.

Entertainment chair 100 may accommodate one or more users. In one embodiment of this invention, entertainment chair 100 accommodates two users and movements of both users prompt separate signals from entertainment chair 100 to an entertainment medium.

Further, entertainment chair 100 may have at least one tactile transducer (not shown), such as, for example, a mechanical vibrator, one or more auditory transducers (not shown), or both, desirably contained within entertainment chair 100, and preferably within base 113 and/or arm 114, so as to be protected during shipping and further provide a streamlined profile for entertainment chair 100. Base 113 and/or arm 114 of entertainment chair 100 may contain at least a portion of one or more speakers. The one or more speakers are may be integrated with respect to base 113 and/or arm 114 to allow for easy shipping and/or storage of entertainment chair 100.

The auditory transducers, such as, for example, speakers, may desirably be protected but opened to the ambient environment for a clear reproduction of sound, such as by having a perforated grill, a screen and/or a cover. Means for powering the vibrator or speakers may be provided by an electric cord leading to an amplifier, a transformer, a rectifier, or the like as will be understood in the art.

The entertainment chair may further include an input/output and/or control panel (not shown), which provides means for operably connecting entertainment chair 100 to an entertainment medium so as to receive a signal produced from the entertainment medium. The input/output (I/O) and control panel may also provide a headphone jack, on/off switch, volume and/or vibration controls such as potentiometers or the like.

The control panel may include one or more separate adjustment devices for vibration; for tone such as bass/treble; and/or for volume. A knob, toggle, button or similar adjustment device may be used to adjust the desired parameter or parameters. In addition, the control panel may include a power switch, one or more headphone jacks and/or one or more input jacks. The control panel may further include one or more "audio out" jacks for connecting one or more entertainment chairs and/or other audio/vibration devices in series.

The vibrator and/or speakers may be separately connected to the respective adjustment device and thereby separately and independently controllable. As such, a speaker may be positioned with respect to seating surface 122 and a vibrator may be positioned with respect to base 113. A control, such as a control panel, for controlling a volume output of the speaker and a vibration output of the vibrator is connected with respect to the speaker and the vibrator so that a volume output is independent of a vibration output. According to a preferred embodiment of this invention, vibrator and/or speaker are operably connectable to an entertainment medium so as to be responsive to a signal produced from the entertainment medium.

As described, the control, such as a control panel, includes volume control for controlling the volume output of the speaker; a bass/treble control for controlling the frequency or tonal output of the speaker; and/or a vibration control for controlling the vibration output of the vibrator. According to a preferred embodiment of this invention, vibration control produces a vibration output from the vibrator independent of a volume output of the speaker. Likewise, according to a preferred embodiment of this invention, volume control produces a volume output from a speaker independent of the vibration output of vibrator. As such, depending upon the desired application, a user can adjust volume control down or off and vibration control to a desired level resulting in vibration output from entertainment chair 10 but no volume output. Conversely, the user can adjust vibration control down or off and volume control to a desired level and avoid any vibration output. As a result of the described embodiment of entertainment chair 100 having both a vibrator and a speaker, the resulting entertainment chair 100 does not necessarily rely on the speaker, such as a transducer or low frequency bass output, for vibration. This may have applicability if the user does not want vibrations during a period of music listening or if the user does not want appreciable speaker volume during video game play involving tactile response features.

Alternatively, vibration is derived entirely from speaker output, such as a transducer or low frequency bass output, for vibration. In such an embodiment, a volume control may be the sole means of adjusting both a volume output and a vibration output.

As a result of the described configuration, entertainment chair 10 may include one or more vibrators and one or more speakers that have dependent or independent control and output. The resulting entertainment chair 100 is thereby entirely flexible to user selected volume, vibration and/or tone.

According to one embodiment of entertainment chair 100, not shown in the figures, a compartment may be formed by or within base 113. In one preferred embodiment of this invention, entertainment chair 100 further comprises seating surface 122 covering at least a portion of the compartment. Vibrator and/or game controls may be mounted to the surface of the seating surface facing the compartment. The compartment may further contain a speaker which might be a speaker of the subwoofer-type whose sonic vibrations are enhanced by the cavity of the compartment. Suitable electrical connections (not shown) between the electrical and electronic components may be easily routed through the compartment. The compartment may further provide storage for entertainment media, headphones, or the like (not shown).

An exemplary embodiment of a vibrator for use in the present invention, may comprise at least an electric motor with a motor shaft. The motor shaft may be coupled to an eccentric weight. A housing desirably contains the motor, the motor shaft, and the eccentric weight. As described, the eccentric weight is mounted to a separate shaft which is coupled to the motor shaft by a mechanical coupling at a first end of the separate shaft. A second end of the separate shaft is coupled to the housing. A connector plate is affixed to, or integral with, the housing for mounting the vibrator, preferably in a direct coupling to an entertainment chair. An amplifier may be connected to the motor for control of vibration level. For example, as a sound volume of the entertainment media increases, the power to the motor may correspondingly increase, thereby increasing the rotational speed or torque of the motor and the turning of the eccentric weight, thereby increasing the vibration. Control of the amplifier settings may be had through the I/O and control panel.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. An entertainment chair comprising:

a base;

a bottom surface positioned on a lower portion of the base;

a support surface formed with respect to the bottom surface, wherein the support surface is a convex support surface and the support surface is removably attachable to the bottom surface;

a seating surface opposite the bottom surface; and an internal gaming control for translating movement of a user to an entertainment system.

2. The entertainment chair of claim 1, further comprising a backrest integrated with the base.

3. The entertainment chair of claim 1, further comprising a means for rolling mountable with respect to the bottom surface.

4. The entertainment chair of claim 1, further comprising at least one tactile transducer.

5. The entertainment chair of claim 1, further comprising at least one auditory transducer.

6. The entertainment chair of claim 1, further comprising a control panel operably connecting the entertainment chair to an entertainment medium.

7. The entertainment chair of claim 6, wherein the control panel includes at least one control selected from the group consisting of a power on control, a power off control, a volume control, a tone control, a vibration control, and combinations thereof.

8. The entertainment chair of claim 1, wherein the support surface includes a slip-proof material.

9. The entertainment chair of claim 1, wherein the convex support surface permits 360 degrees of rotation of the base relative to a floor surface.

10. The entertainment chair of claim 1, further comprising an arm integrated with the base, the arm extending from the base at an angle of between about 30 degrees and about 80 degrees relative to a floor surface.

11. The entertainment chair of claim 10, further comprising a handle mounted with respect to an end of the arm opposite the base.

12. An entertainment chair comprising:

a base;

a bottom surface positioned on a lower portion of the base;

a support surface connected with respect to the bottom surface, wherein the support surface is a convex support surface permitting 360 degrees of rotation of the base relative to a floor surface and the support surface is removably attachable to the bottom surface;

a seating surface opposite the bottom surface;

a backrest integrated with the base;

a means for operably connecting the entertainment chair to an entertainment medium for receiving and responding to a signal produced by the entertainment medium; and an internal gaming control for translating movement of a user to the entertainment medium.

13. The entertainment chair of claim 12, wherein the means for operably connecting the entertainment chair to an entertainment medium comprise a control panel, wherein the control panel includes at least one control selected from the group consisting of a volume control, a vibration control, a power on control, a power off control, an input control, an output control, a tone control, an audio control, and combinations thereof.

14. The entertainment chair of claim 12, further comprising a compartment formed within the base.

15. An entertainment chair comprising:

a base;

a bottom surface positioned on a lower portion of the base;

a support surface connected with respect to the bottom surface, wherein the support surface is a convex support surface permitting 360 degrees of rotation of the base relative to a floor surface and wherein the support surface is removably attachable to the bottom surface;

a seating surface opposite the bottom surface;

a backrest integrated with the base;

at least one tactile transducer positioned with respect to the base;

at least one auditory transducer positioned with respect to the base;

an internal gaming control for translating movement of a user to an entertainment medium; and a means for operably connecting the entertainment chair to an entertainment medium for receiving and responding to a signal produced by the entertainment medium.

16. The entertainment chair of claim 15, further comprising an audio device connected with the chair.

* * * * *